US008641562B1

(12) United States Patent
Tuttle

(10) Patent No.: US 8,641,562 B1
(45) Date of Patent: Feb. 4, 2014

(54) TABLE TENNIS SYSTEM

(76) Inventor: Jerry Tuttle, Sunbury, OH (US)

( * ) Notice: Subject to any disclaimer, the term of this patent is extended or adjusted under 35 U.S.C. 154(b) by 87 days.

(21) Appl. No.: 13/472,478

(22) Filed: May 16, 2012

(51) Int. Cl.
*A63B 67/04* (2006.01)

(52) U.S. Cl.
USPC ..... 473/475

(58) Field of Classification Search
USPC ..... 473/475, 462, 465, 473, 474, 476, 496
See application file for complete search history.

(56) References Cited

U.S. PATENT DOCUMENTS

| | | | | |
|---|---|---|---|---|
| 2,949,305 | A | 8/1960 | Davis | |
| 3,001,791 | A * | 9/1961 | Atwood | 473/470 |
| 3,117,783 | A * | 1/1964 | Reid | 473/470 |
| 3,942,795 | A | 3/1976 | Psenka | |
| 4,010,952 | A * | 3/1977 | Young | 473/470 |
| 5,470,057 | A * | 11/1995 | Bodford, Jr. | 473/416 |
| 5,575,471 | A * | 11/1996 | Robinson et al. | 473/475 |
| 5,655,979 | A * | 8/1997 | Blue | 473/475 |
| D409,698 | S | 5/1999 | Beckham et al. | |
| 7,727,091 | B2 | 6/2010 | Allen | |
| 2011/0294608 | A1 * | 12/2011 | Klest | 473/462 |

* cited by examiner

*Primary Examiner* — Raleigh W Chiu

(57) ABSTRACT

A bottle pong table tennis system uses a plurality of sinker balls placed on bottle pong bottles in a novel variant of a table tennis game where multiple balls are in simultaneous play. The system has a regulation table tennis ball that is white in color. The system has a plurality of sinker balls that are orange in color. The system has a regulation table tennis table, a plurality of regulation table tennis rackets, and a plurality of bottle pong bottles. For use, a first bottle pong bottle is placed on a white center line about 19½ inches from a table tennis table first edge and a second bottle pong bottle is placed on the white center line about 19½ inches from a table tennis table second edge. A sinker ball is placed on each bottle top.

3 Claims, 4 Drawing Sheets

TABLE TENNIS SYSTEM

BACKGROUND OF THE INVENTION

Table tennis, or ping-pong is generally know as a sport where two or four players hit a small, hollow ball back and forth across a table with a dividing net using table tennis rackets. Originating during the 1880s, as the sport's popularity began to grow, tournaments began to be organized by the early 1900s. Throughout the past century, table tennis has continued to gain in popularity even to this day. The present invention features a table tennis system using a plurality of sinker balls placed on bottle pong bottles in a novel variant of a table tennis game where multiple balls are in simultaneous play.

SUMMARY

The present invention features a table tennis system using a plurality of sinker balls placed on bottle pong bottles in a novel variant of a table tennis game where multiple balls are in simultaneous play. In some embodiments, the system comprises a regulation table tennis ball. In some embodiments, the table tennis ball is white in color. In some embodiments, the system comprises a plurality of sinker balls. In some embodiments, the sinker ball is orange in color.

In some embodiments, the system comprises a regulation table tennis table. In some embodiments, the system comprises a plurality of regulation table tennis rackets. In some embodiments, the system comprises a plurality of bottle pong bottles. In some embodiments, the bottle top is sized for placing a sinker ball thereon.

In some embodiments, for use, the bottle pong bottle is placed on a white center line about 19½ inches from a table tennis table first edge. In some embodiments, for use, the bottle pong bottle is placed on the white center line about 19½ inches from a table tennis table second edge. In some embodiments, the sinker ball is placed on the bottle top.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
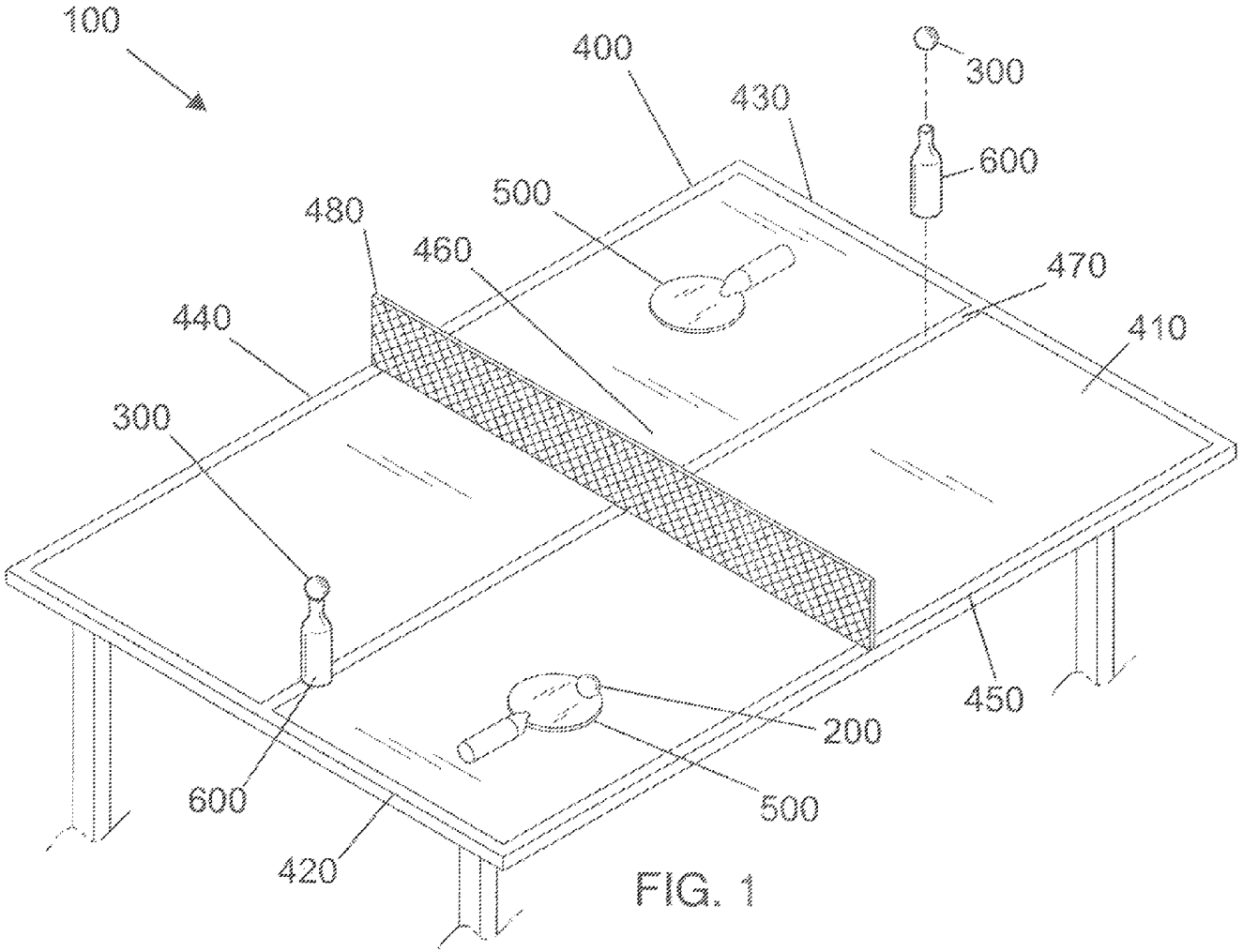
FIG. 1 is a perspective view of the present invention.

Following is a list of elements corresponding to a particular element referred to herein:

100 Bottle pong table tennis system
200 Table tennis ball
300 Sinker ball
400 Table tennis table
410 Table tennis table top surface
420 Table tennis table first edge

Figure 2:
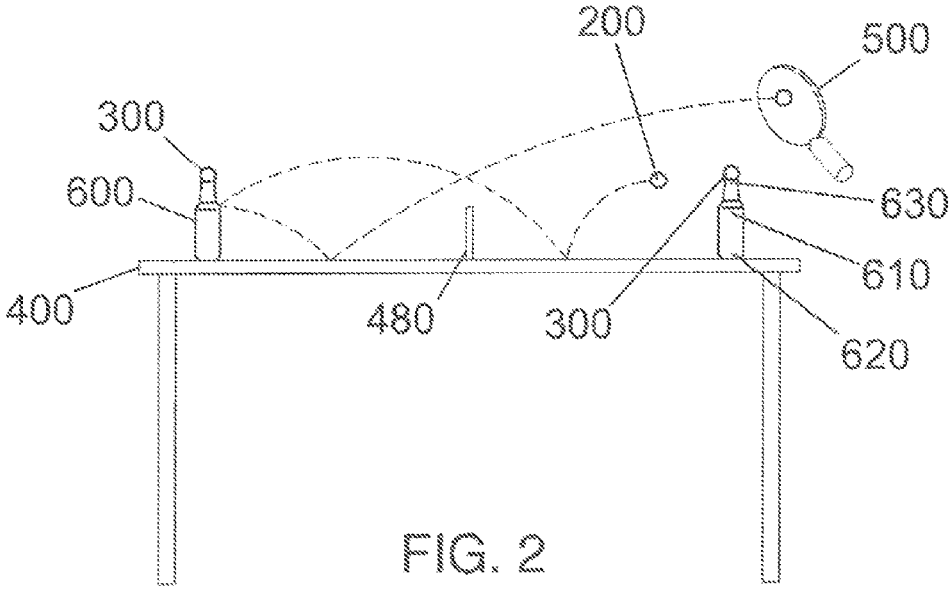
FIG. 2 is a side view of the present invention in use.
Figure 3:
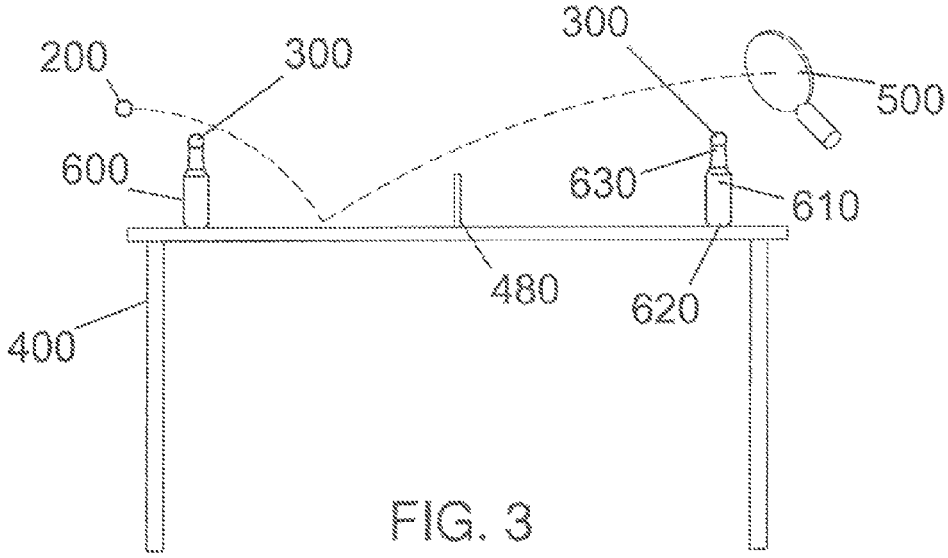
FIG. 3 is a side view of the present invention in use.
Figure 4:
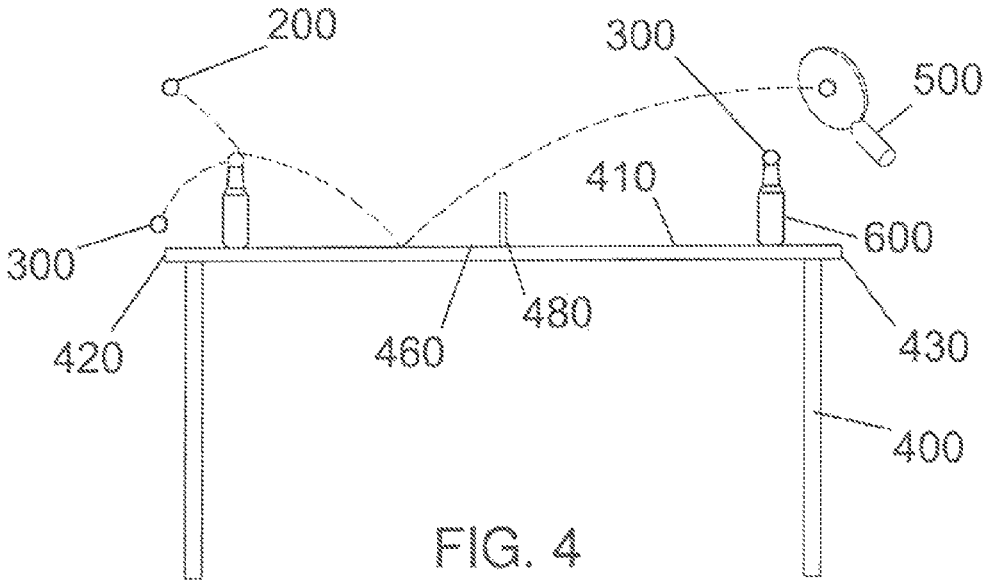
FIG. 4 is a side view of the present invention in use.
Figure 5:
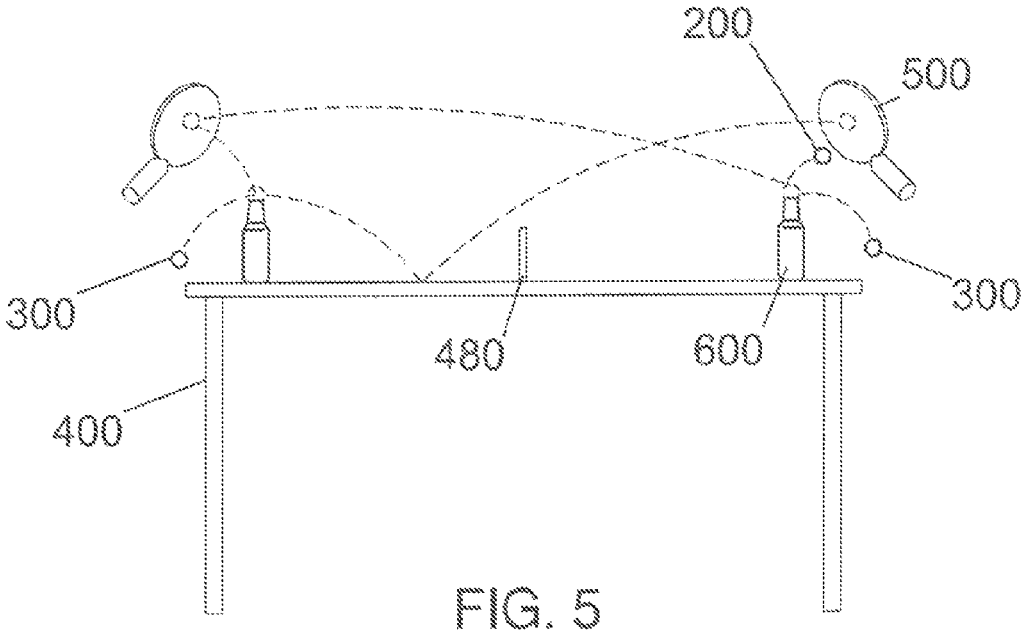
FIG. 5 is a side view of the present invention in use.
Figure 6:
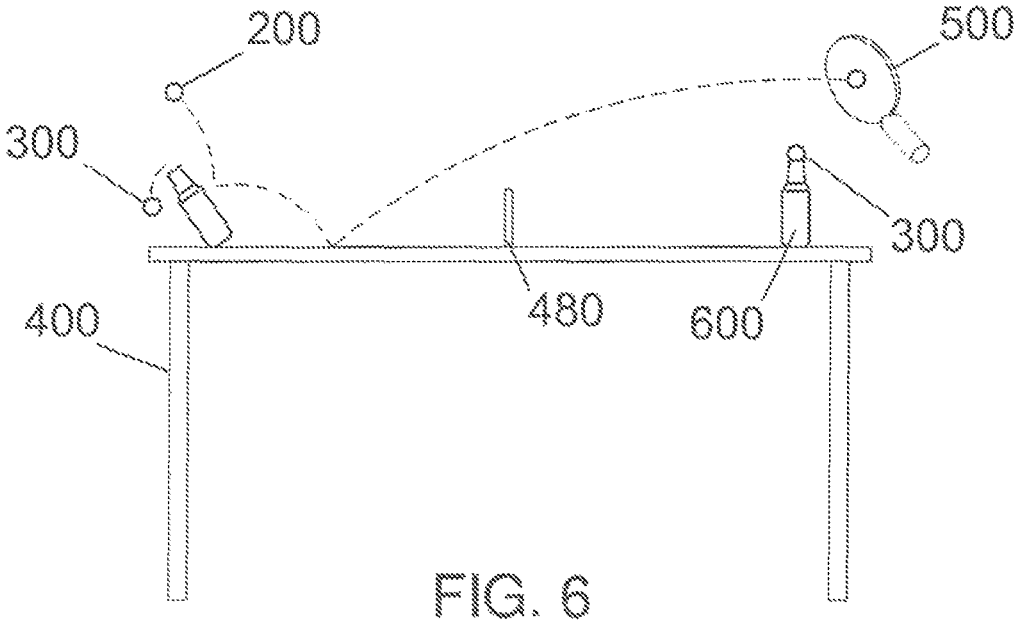
FIG. 6 is a side view of the present invention in use.

430 Table tennis table second edge
440 Table tennis table third edge
450 Table tennis table fourth edge
460 Table tennis table middle region
470 White center line
460 Net
500 Table tennis racket
600 Bottle pong bottle
610 Bottle middle region
620 Bottle base
630 Bottle top Referring now to FIG. 1-6, the present invention features a table tennis system (100) using a plurality of sinker balls (300) initially placed on bottle pong bottles (600) in a novel variant of a table tennis game. In some embodiments, multiple balls are in simultaneous play.

In some embodiments, the system (100) comprises a regulation table tennis ball (200). In some embodiments, the table tennis ball (200) is about 40 millimeters in diameter. In some embodiments, the table tennis ball (200) comprises a weight of about 2.7 grams. In some embodiments, the table tennis ball (200) is white in color.

In some embodiments, the system comprises a plurality of sinker balls (300). In some embodiments, the sinker ball (300) is about 40 millimeters in diameter. In some embodiments, the sinker ball (300) comprises a weight of about 2.7 grams. In some embodiments, the sinker ball (300) is orange in color.

In some embodiments, the system comprises a regulation table tennis table (400). In some embodiments, the table tennis table (400) is about 9 feet in length. In some embodiments, the table tennis table (400) is about 5 feet in width. In some embodiments, the table tennis table (400) is about 30 inches in height from a ground surface. In some embodiments, the table tennis table (400) comprises a generally planar table tennis table top surface (410) having a generally linear white center line (470) located thereon from a middle of a table tennis table first edge (420) to a middle of a table tennis table second edge (430). In some embodiments, the top surface is green or blue in color. In some embodiments, the table tennis table (400) further comprises a generally planar net (480) located perpendicularly with respect to the table tennis table top surface (410) from a middle of a table tennis table third edge (440) to a middle of a table tennis table fourth edge (450) across a table tennis table middle region (460). In some embodiments, the net (480) is about 6 inches in height.

In some embodiments, the system (100) comprises a plurality of regulation table tennis rackets (500). In some embodiments, the system (100) comprises a plurality of bottle pong bottles (600). In some embodiments, the bottle pong bottle (600) is about 7¼ inches in height. In some embodiments, the bottle comprises a cross-section in a bottle middle region (610) in a transverse plane about 2¾ inches in diameter. In some embodiments, the bottle pong bottle (600) tapers from the bottle middle region (610) to a bottle base (620). In some embodiments, the bottle base (620) is about 1¾ inches in diameter. In some embodiments, the bottle pong bottle (600) tapers from the bottle middle region (610) to the bottle top (630). In some embodiments, the bottle top (630) is sized for placing a sinker ball (300) thereon. In some embodiments, the bottle pong bottle (600) comprises a weight of about 76.5 grams.

In some embodiments, for use, a first bottle pong bottle (600) is placed on the white center line (470) about 19½ inches from a table tennis table first edge (420). In some embodiments, for use, a second bottle pong bottle (600) is placed on the white center line (470) about 19½ inches from a table tennis table second edge (430).

In some embodiments, for use, the sinker ball (300) is placed on the bottle top (630).

In some embodiments, the bottle pong table tennis system (100) is for using the plurality of sinker balls (300) located on the plurality of bottle pong bottles (600) in a novel variant of a table tennis game having multiple balls in simultaneous play.

In some embodiments, the system (100) comprises 2 sinker balls (300). In some embodiments, the system (100) comprises 2 bottle pong bottles (600).

OVERVIEW. In some embodiments, the Bottle Pong Table Tennis System (100) is played using a regulation table tennis table (400). In some embodiments, the system (100) is similar to Ping Pong with a few additions to the normal rules. In some embodiments, in addition to the normal Ping Pong equipment (table tennis rackets (500), table tennis ball (200)), there are also two bottle pong bottles (600), one placed on each side of the net (480), each with a sinker ball (300) on top. In some embodiments, knocking the sinker ball (300) from the top of the opponent's bottle pong bottle (600) puts it into play. In some embodiments, the real test of skill is keeping track of and returning more than one ball at a time.

EQUIPMENT. In some embodiments, the equipment includes a table tennis table (400) and accessories (table tennis racket (500), net (480)), two bottle pong bottles (600), one table tennis ball (200), and two sinker balls (300).

SET UP. In some embodiments, two bottle pong bottles (600) are placed an the white center line (470), each 19½ inches from each end of the table tennis table (400). In some embodiments, a sinker ball (300) is placed on top of each bottle pong bottle (600). In some embodiments, the table tennis ball (200), referred to as the "ball in play" is used for serving.

NUMBER OF PLAYERS. In some embodiments, the Bottle Pong Table Tennis System (100) is played with two people, one at each end of the table tennis table (400), similar to Ping Pong.

THE OBJECT OF THE GAME. In some embodiments, the object of the Bottle Pong Table Tennis System (100) is to either knock your opponents bottle pong bottle (600) over or knock the sinker ball (300) from the bottle top (630) of your opponents bottle pong bottle (600), or both, while otherwise playing by normal Ping Pong rules. In some embodiments, at no time should you hit your own bottle pong bottle (600) or sinker ball (300). In some embodiments, at times during the course of the game there may be more than one ball in play as the sinker balls (300) are knocked off their respective bottle pong bottles (600). In some embodiments, the two bottle pong bottles (600) positioned on the table tennis table (400) are in fair play. In some embodiments, except on a serve, balls that hit the bottle pony bottles (600) are still in play to be returned.

SERVING. In some embodiments, serving is similar to regular Ping Pong except hitting the opponent's bottle pong bottle (600) or sinker ball (300) on the serve is not allowed. In some embodiments, a serve hitting the opponent's bottle pong bottle (600) or sinker ball (300) is considered the same as a table tennis ball (200) that hits the net (480) and bounces over. In some embodiments, if it happens twice or in combination with a net ball, a point goes to the opponent.

HOW POINTS ARE SCORED. In some embodiments 1 point is scored by the person last hitting the table tennis ball (200) in play fairly, using regular Ping Pony rules.

In some embodiments, if the table tennis ball (200) in play knocks the sinker ball (300) off the opponent's bottle pony bottle (600), 2 points are scored. In some embodiments, the opponent has the opportunity to return the table tennis ball (200) in play and the sinker ball (300) (which now becomes a second ball in play) back over the net (480) and continue playing using regular Ping Pong rules except with two balls instead of just one. In some embodiments, for each ball that is not returned fairly, one point is scored by the other player. In some embodiments, for example, if the opponent returns the ball in play, but not the sinker ball (300), one point automatically goes to the player who knocked the sinker ball (300) off the bottle pong bottle (600) and the game continues until the ball in play is not returned by one of the players. In some embodiments, the player who last returns the ball in play fairly, wins the other point. In some embodiments, if, for instance both the ball in play and the sinker ball (300) are returned after the sinker ball (300) is knocked off the bottle pony bottle (600), and the player who knocked it off fails to return either ball fairly, 2 points go to the opponent.

In some embodiments, 3 points are possible when the opponent's bottle pong bottle (600) is knocked over by the other player. In some embodiments, the player knocking over the opponents bottle pong bottle (600) automatically scares one point and the 2 balls are played as described above until both balls are no longer in play.

In some embodiments, it is unlikely, but possible to have three balls in play at the same time if both sinker balls (300) are knocked off the bottle pong bottles (600). In some embodiments, in this case each ball in play is scored as if it were the only ball. At least three points will be scored when this occurs (possibly 2 more if both bottle pong bottles (600) are knocked over).

in some embodiments, when a player knocks his or her own bottle pong bottle (600) over or the sinker ball (300) off the bottle pong bottle (600) while playing the Bottle Pong Table Tennis System (100) the points go to the opponent.

WINNING POINT. In some embodiments, like regular Ping Pong, you must win by two points. In some embodiments, the winning point cannot be made by hitting the opponent's sinker ball (300) or bottle pong bottle (600).

HOW TO BEGIN THE GAME. In some embodiments, the ball in play is used for serving as in normal Ping Pong. In some embodiments, the last player hitting the ball safely wins the points.

As used herein, the term "about" refers to plus or minus 10% of the referenced number. For example, an embodiment wherein the bottle pong bottle is about 10 inches in length includes a bottle pong bottle that is between 9 and 11 inches in length.

The disclosures of the following U.S. Patents are incorporated in their entirety by reference herein: U.S. Pat. No. D 497,076; U.S. Pat. No. D 485,115; U.S. Pat. No. D 442,818; U.S. Pat. No. D 436,284; U.S. Pat. No. D 429,944; U.S. Pat. No. 6,298,774.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

In some embodiments, the bottle pong bottle (600) comprises a combined weight of about 76.5 grams. In some embodiments the bottle pong bottle (600) comprises an initial weight of about 30 to 40 grams with an additional weight of about 40.5 to 50.5 grams placed at or close to the bottom of the bottle. In some embodiments the bottle pong bottle (600) comprises an initial weight of about 20 to 30 grams with an additional weight of about 30.5 to 40.5 grams placed at or close to the bottom of the bottle. In some embodiments the bottle pong bottle (600) comprises an initial weight of about 40 to 50 grams with an additional weight of about 50.5 to 60.5 grams placed at or close to the bottom of the bottle. In some embodiments, the additional weight placed at or close to the bottom of the bottle keeps the bottle from tipping over easy.

What is claimed is:

1. A table tennis system (100) using a plurality of sinker balls (300) initially placed on bottle pong bottles (600) in a novel variant of a table tennis game, wherein multiple balls are in simultaneous play, wherein said system (100) comprises:

(a) a regulation table tennis ball (200), wherein the table tennis ball (200) is about 40 millimeters in diameter, wherein the table tennis ball (200) comprises a weight of about 2.7 grams, wherein the table tennis ball (200) is white in color;

(b) a plurality of sinker balls (300), wherein the sinker ball (300) is about 40 millimeters in diameter, wherein the sinker ball (300) comprises a weight of about 2.7 grams, wherein the sinker ball (300) is orange in color;

(c) a regulation table tennis table (400), wherein the table tennis table (400) is about 9 feet in length, wherein the table tennis table (400) is about 5 feet in width, wherein the table tennis table (400) is about 30 inches in height from a ground surface, wherein the table tennis table (400) comprises a generally planar table tennis table top surface (410) having a generally linear white center line (470) disposed thereon from a middle of a table tennis table first edge (420) to a middle of a table tennis table second edge (430), wherein the table tennis table top surface (410) is green or blue in color, wherein the table tennis table (400) further comprises a generally planar net (480) disposed perpendicularly with respect to the table tennis table top surface (410) from a middle of a table tennis table third edge (440) to a middle of a table tennis table fourth edge (450) across a table tennis table middle region (460), wherein the net (480) is about 6 inches in height;

(d) a plurality of regulation table tennis rackets (500); and (e) a plurality of bottle pong battles (600), wherein the bottle pong bottle (600) is about 7¼ inches in height, wherein the bottle comprises a cross-section in a bottle middle region (610) in a transverse plane about 2¾ inches in diameter, wherein the bottle pong bottle (600) tapers from the battle middle region (610) to a bottle base (620), wherein the bottle base (620) is about 1¾ inches in diameter, wherein the bottle pong bottle (600) tapers from the bottle middle region (610) to a bottle top (630), wherein the bottle top (630) is sized for placing the sinker ball (300) thereon, wherein the bottle pong bottle (600) comprises a weight of about 76.5 grams;

wherein for use, a first bottle pong bottle (600) is placed on the white center line (470) about 19½ inches from a table tennis table first edge (420), wherein for use, a second battle pong bottle (600) is placed on the white center line (470) about 19 ½ inches from a table tennis table second edge (430), wherein for use, the sinker ball (300) is placed on the bottle top (630), wherein the bottle pong table tennis system (100) is for using the plurality of sinker balls (300) disposed on the plurality of bottle pong bottles (600) in a novel variant of a table tennis game having multiple balls in simultaneous play.

2. The system (100) of claim 1, wherein the system (100) comprises 2 sinker balls (300).

3. The system (100) of claim 1, wherein the system (100) comprises 2 bottle pong bottles (600).

* * * * *